US012797672B2

(12) United States Patent
Xue et al.

(10) Patent No.: US 12,797,672 B2
(45) Date of Patent: Nov. 17, 2026

(54) PULLING FORCE SWITCHING METHOD AND PULLING FORCE SWITCHING DEVICE

(71) Applicant: Yuan Xue, Zibo (CN)

(72) Inventors: Wenhui Xue, Zibo (CN); Pengfei Jiang, Zibo (CN); Huajun Zhang, Zibo (CN); Yao Lyu, Zibo (CN); Yuan Xue, Zibo (CN)

(73) Assignee: Yuan Xue, Zibo (CN)

( * ) Notice: Subject to any disclaimer, the term of this patent is extended or adjusted under 35 U.S.C. 154(b) by 66 days.

(21) Appl. No.: 18/892,622

(22) Filed: Sep. 23, 2024

(65) Prior Publication Data

US 2026/0021340 A1 Jan. 22, 2026

(30) Foreign Application Priority Data

Jul. 16, 2024 (CN) ..... 202410949062.0
Jul. 16, 2024 (CN) ..... 202421683613.5

(51) Int. Cl.
*A63B 21/00* (2006.01)
*A63B 21/062* (2006.01)

(52) U.S. Cl.
CPC ..... *A63B 21/156* (2013.01); *A63B 21/00069* (2013.01); *A63B 21/0628* (2015.10); *A63B 2214/00* (2020.08); *A63B 2225/093* (2013.01)

(58) Field of Classification Search
CPC ..... A63B 21/16–169; A63B 21/062–0632
See application file for complete search history.

(56) References Cited

U.S. PATENT DOCUMENTS 4,648,594 A * 3/1987 Schleffendorf ..... A63B 21/063 482/102
4,775,146 A * 10/1988 Stankovic ..... A63B 23/03533 482/99
4,953,855 A * 9/1990 Shields ..... A63B 21/0628 482/99
5,342,271 A * 8/1994 Long ..... A63B 21/063 482/98
5,417,634 A * 5/1995 Habing ..... A63B 23/1254 482/99
5,476,428 A * 12/1995 Potash ..... A63B 21/063 482/99
6,527,683 B2 * 3/2003 Tolles ..... A63B 23/00 482/99

(Continued)

*Primary Examiner* — Nyca T Nguyen
(74) *Attorney, Agent, or Firm* — Bayramoglu Law Offices LLC

(57) ABSTRACT

A pulling force switching method and a pulling force switching device are provided. The pulling force switching device includes a frame, where a weight stack is movably provided on the frame; the weight stack is detachably connected to a movable pulley; an upper fixed pulley and a lower fixed pulley are fixedly provided on the frame; a rope is wound around the movable pulley; the rope at one side of the movable pulley is connected to a handle, and the rope at the other side of the movable pulley is wound around the upper fixed pulley and the lower fixed pulley sequentially and fixed to a connector; and the connector is detachably connected to the movable pulley to achieve the switching of the pulling force output by the weight stack. Under the same pulling force required for training, the pulling force switching device reduces the number of required weight stacks.

7 Claims, 9 Drawing Sheets

(56) References Cited

U.S. PATENT DOCUMENTS

| | | | | |
|---|---|---|---|---|
| 9,067,100 | B2 * | 6/2015 | Habing | A63B 21/062 |
| 12,005,294 | B2 * | 6/2024 | Chen | A63B 21/169 |
| 12,048,858 | B1 * | 7/2024 | Schroeder | A63B 17/04 |
| 2001/0034290 | A1 * | 10/2001 | Tolles | A63B 21/154 482/99 |
| 2003/0096681 | A1 * | 5/2003 | Myers | A63B 21/063 482/99 |
| 2004/0072659 | A1 * | 4/2004 | Alessandri | A63B 21/154 482/99 |
| 2007/0179030 | A1 * | 8/2007 | Slawinski | A63B 21/0724 482/99 |
| 2013/0296144 | A1 * | 11/2013 | Gvoich | A63B 21/062 482/102 |
| 2015/0111708 | A1 * | 4/2015 | Smith | A63B 21/4033 482/98 |
| 2016/0346590 | A1 * | 12/2016 | Giannelli | A63B 21/4035 |
| 2018/0243599 | A1 * | 8/2018 | Lacey | A63B 21/0058 |
| 2022/0096891 | A1 * | 3/2022 | Yang | A63B 21/0428 |
| 2024/0066347 | A1 * | 2/2024 | Byun | A63B 21/156 |

* cited by examiner

PULLING FORCE SWITCHING METHOD AND PULLING FORCE SWITCHING DEVICE

CROSS REFERENCE TO THE RELATED APPLICATIONS

This application based upon and claims priority to Chinese Patent Application No. 202410949062.0, filed on Jul. 16, 2024, and Chinese Patent Application No. 202421683613.5, filed on Jul. 16, 2024, the entire contents of which are incorporated herein by reference.

TECHNICAL FIELD

The present disclosure relates to a pulling force switching method and pulling force switching device, and belongs to the technical field of fitness equipment.

BACKGROUND

As a type of multifunctional fitness equipment, the comprehensive pull workout device integrates multiple training functions and can be used for workouts targeting different muscle groups. It typically includes an adjustable resistance system, various grips and brackets, as well as accessories for simulating different movements. Users can improve muscle strength, endurance, and coordination by changing the grip position and using different accessories for targeted strength workouts.

A weight stack is an indispensable part of the comprehensive pull workout device, and a rope is connected to the weight stack after being wound around multiple sets of pulleys. Users can adjust the gravity of the weight stack according to their needs to change the magnitude of the pulling force. The existing comprehensive pull workout device is provided with a movable pulley. Based on the labor-saving principle of the movable pulley, the force required to pull up the weight stack during a pull workout is only half of the gravity of the weight stack. Therefore, in order to achieve greater pulling force output, manufacturers need to equip more weights. However, this increases the production cost and total gravity of the comprehensive pull workout device, making it bulky and inconvenient to move and transport, thereby increasing transportation cost.

SUMMARY

In view of the above-mentioned shortcomings in the prior art, a technical problem to be solved by the present disclosure is to provide a pulling force switching method and pulling force switching device. The present disclosure can change the pulling force output by the weight stack to make the output pulling force equal to the gravity or half of the gravity of the weight stack. Under the same pulling force required for training, the present disclosure reduces the number of weights required, thereby reducing the production and transportation costs of the workout device.

The pulling force switching method includes the following steps:

S1: lifting a weight stack to a position below a movable pulley, and connecting a rope at one side of the movable pulley to a handle as a force application end;

S2: winding the rope at the other side of the movable pulley upwards around a fixed pulley located higher than the movable pulley, winding the rope downwards around a fixed pulley located lower than the movable pulley, and finally fixing the rope to a connector, where the connector is detachably connected to the movable pulley; a support member is located below the connector; and the support member is configured to restrict a lower limit position of the connector; and S3: separating the connector from the movable pulley, and pulling the handle, such that the connector is supported by the support member, and a pulling force at the force application end is half of a gravity of the weight stack; and connecting the connector to the movable pulley, and pulling the handle, such that the connector is driven by the movable pulley, and a pulling force at the force application end is equal to the gravity of the weight stack.

The pulling force switching device is based on the pulling force switching method, and includes a frame, where the weight stack is movably provided on the frame; the weight stack is detachably connected to the movable pulley; an upper fixed pulley and a lower fixed pulley are fixedly provided on the frame; a position of the upper fixed pulley is higher than a position of the movable pulley; and a position of the lower fixed pulley is lower than the position of the movable pulley; and the rope is wound around the movable pulley; the rope at one side of the movable pulley is connected to the handle, and the rope at the other side of the movable pulley is wound around the upper fixed pulley and the lower fixed pulley sequentially and fixed to the connector; the connector is movable; the support member is located below the connector to restrict the lower limit position of the connector; and the connector is detachably connected to the movable pulley.

Preferably, a guide shaft is fixedly provided on the frame; the weight stack is slidably connected to the guide shaft; a pull rod is suspended below the movable pulley; the weight stack is detachably connected to the movable pulley through the pull rod; and the connector is detachably connected to the movable pulley through the pull rod.

Preferably, the connector is defined as a connector A, and the pull rod is defined as a pull rod A; the connector A includes an inner core and an outer cylinder; the outer cylinder is sleeved outside the inner core and fixedly connected to the inner core; and the inner core is fixedly connected to an end of the rope.

Further, an inner wall of the outer cylinder is provided with a protrusion; a bottom of the pull rod A is provided with a groove that matches the protrusion; the groove is in an inverted L-shape; a long side of the groove is communicated with an end position of the pull rod A; the protrusion of the outer cylinder is aligned with and insert into the groove of the pull rod A; and then the outer cylinder is rotated to connect the pull rod A to the connector A.

Preferably, the connector is defined as a connector B, and the pull rod is defined as a pull rod B; the connector B is provided with a hook; and a bottom of the pull rod B is provided with a suspension ring that matches the hook.

Preferably, the connector is defined as a connector C, and the pull rod is defined as a pull rod C; the connector C is provided with an internal thread; and a bottom of the pull rod C is provided with an external thread that matches the internal thread.

Preferably, the connector is defined as a connector D, and the pull rod is defined as a pull rod D; the connector D is provided with a ball head; and a bottom of the pull rod D is provided with an open groove that matches the ball head.

Preferably, the pull rod A is provided with multiple weight stack connection holes; a side of the weight stack is provided with through-holes; positions of the weight stack connection holes correspond to positions of the through-holes of the weight stack; and the pull rod A is connected to the weight stack through the weight stack connection holes.

Preferably, after extending upwards, the rope on the movable pulley close to a force application side is wound around multiple fixed pulleys and connected to the handle; the handle is restricted by a fly sliding sleeve; and the fly sliding sleeve is rotatably connected to a sliding sleeve connector to adapt to a change in a direction of force application.

Preferably, the sliding sleeve connector is slidably provided on a longitudinal adjustment beam of the frame; the longitudinal adjustment beam is made of a square tube profile and provided with multiple adjustment holes; the sliding sleeve connector is provided with a spring pin and connected to the longitudinal adjustment beam through the spring pin; to adjust a height of the fly sliding sleeve, the spring pin is pulled outward to separate the spring pin from the longitudinal adjustment beam; and after the fly sliding sleeve is adjusted to an appropriate height, the spring pin is released; the spring pin is reset by an internal spring, allowing the spring pin to be locked and connected again to the longitudinal adjustment beam.

Preferably, a bottom of the guide shaft is provided with a support sleeve; the support sleeve is configured to support the weight stack; and a shock-absorbing pad is located above the support sleeve for shock absorption.

Compared with the prior art, the present disclosure has the following beneficial effects:

In the pulling force switching method and pulling force switching device described in the present disclosure, a connector is provided, which is detachably connected to the movable pulley, achieving the switching of the pulling force output by the weight stack. When the connector is connected to the pull rod, the pulling force output by the weight stack is equal to its own gravity. When the connector is disconnected from the pull rod, the pulling force output by the weight stack is equal to half of its own gravity. Under the same pulling force required for training, the present disclosure reduces the number of weights required for the comprehensive pull workout device. Therefore, the present disclosure reduces the production cost and total weight of the workout device, making it easy to move and transport, thereby reducing transportation cost.

Figure 1:
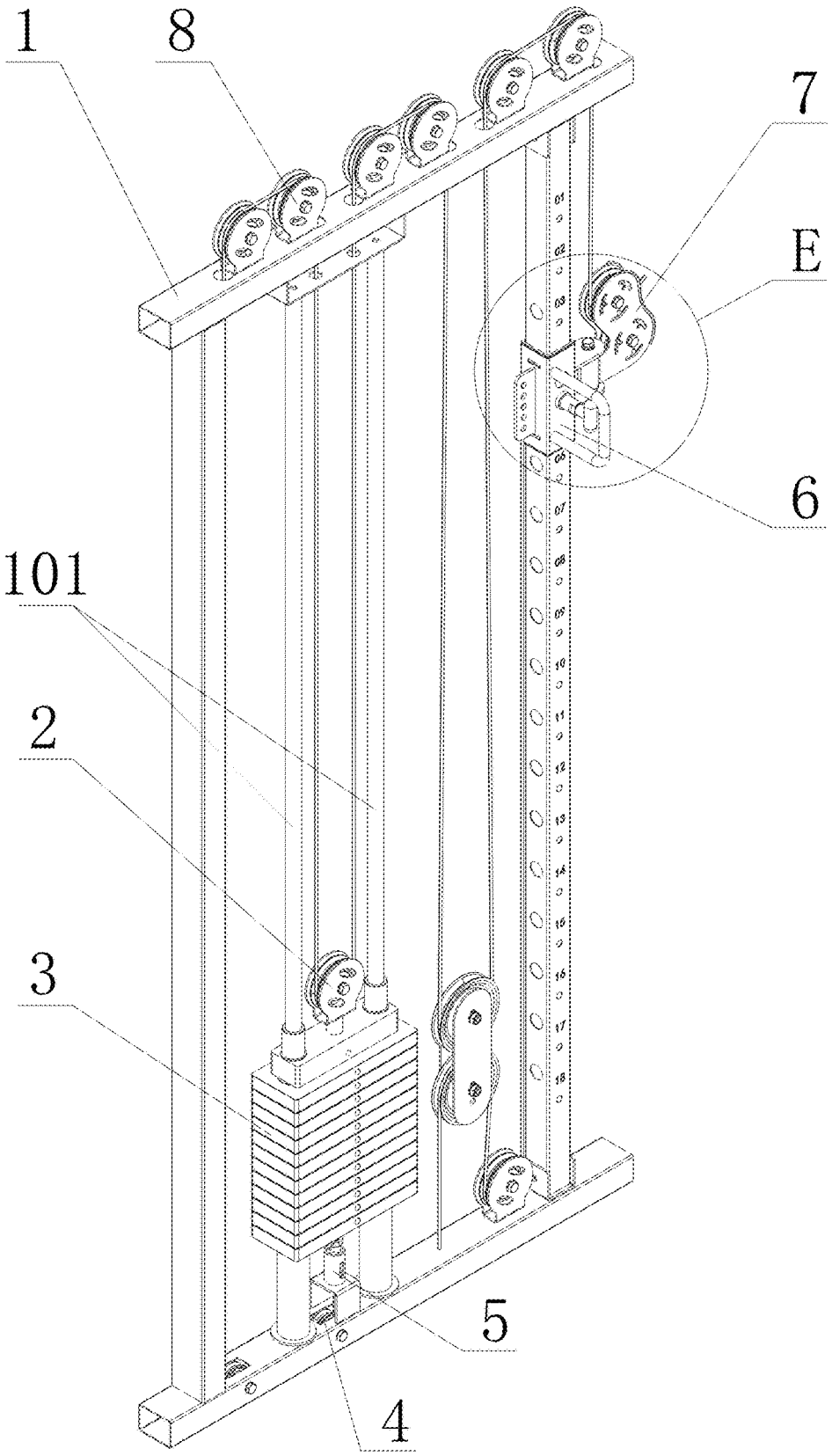
FIG. 1 is a structural diagram of Embodiment 1 according to the present disclosure.
Figure 2:
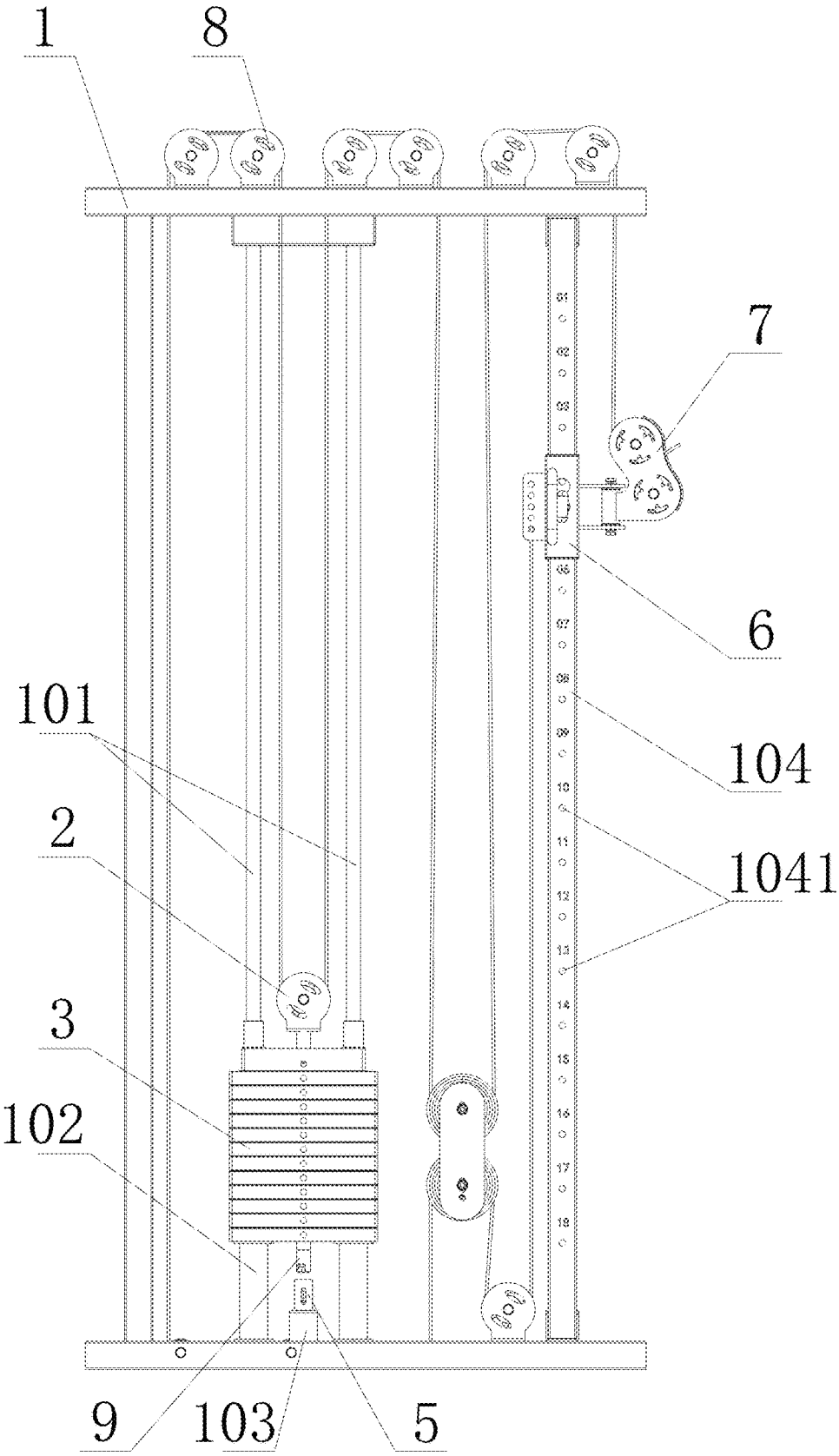
FIG. 2 is a front view of Embodiment 1 according to the present disclosure.
Figure 3:
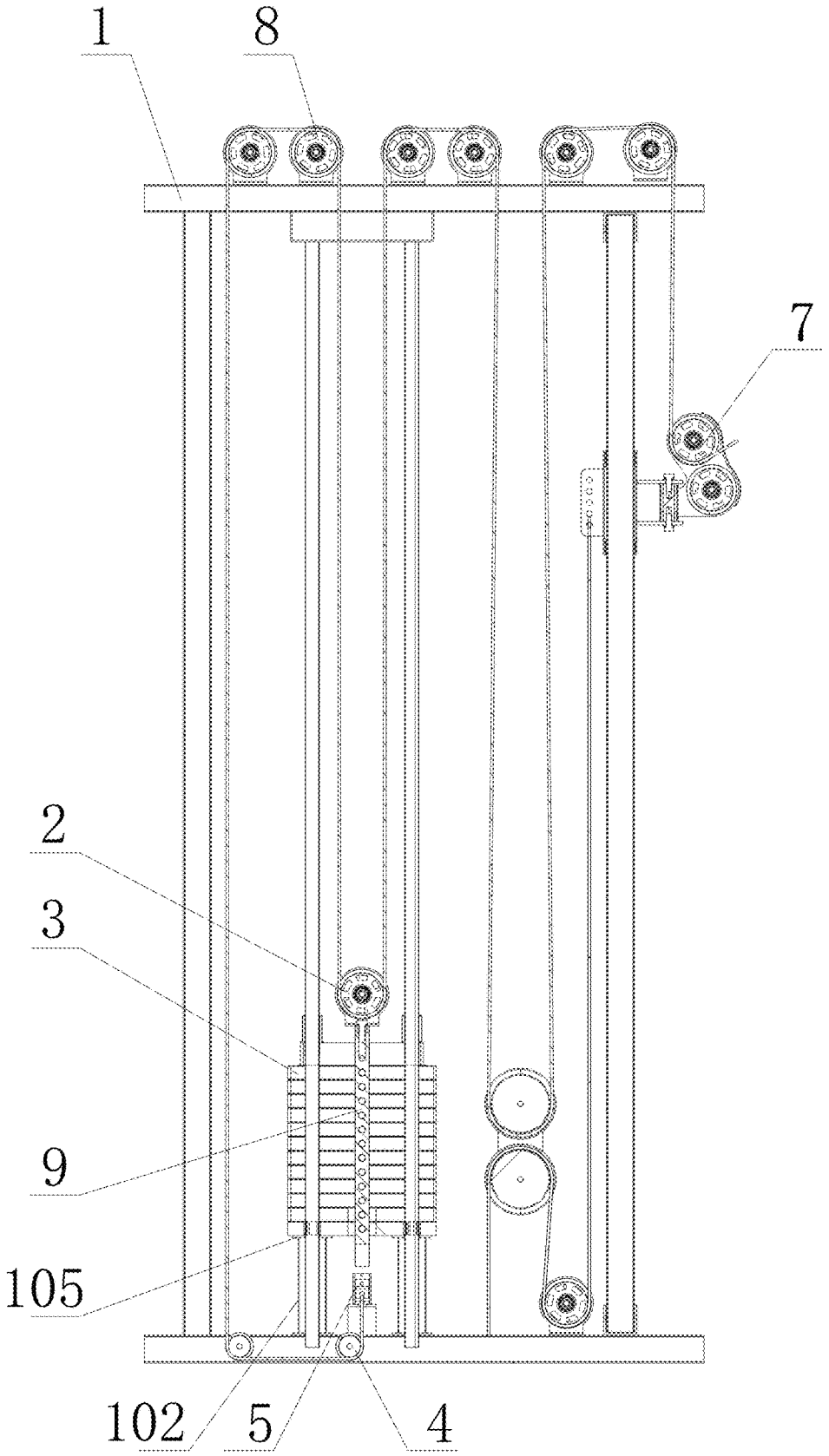
FIG. 3 is a front section view of Embodiment 1 according to the present disclosure.
Figure 4:
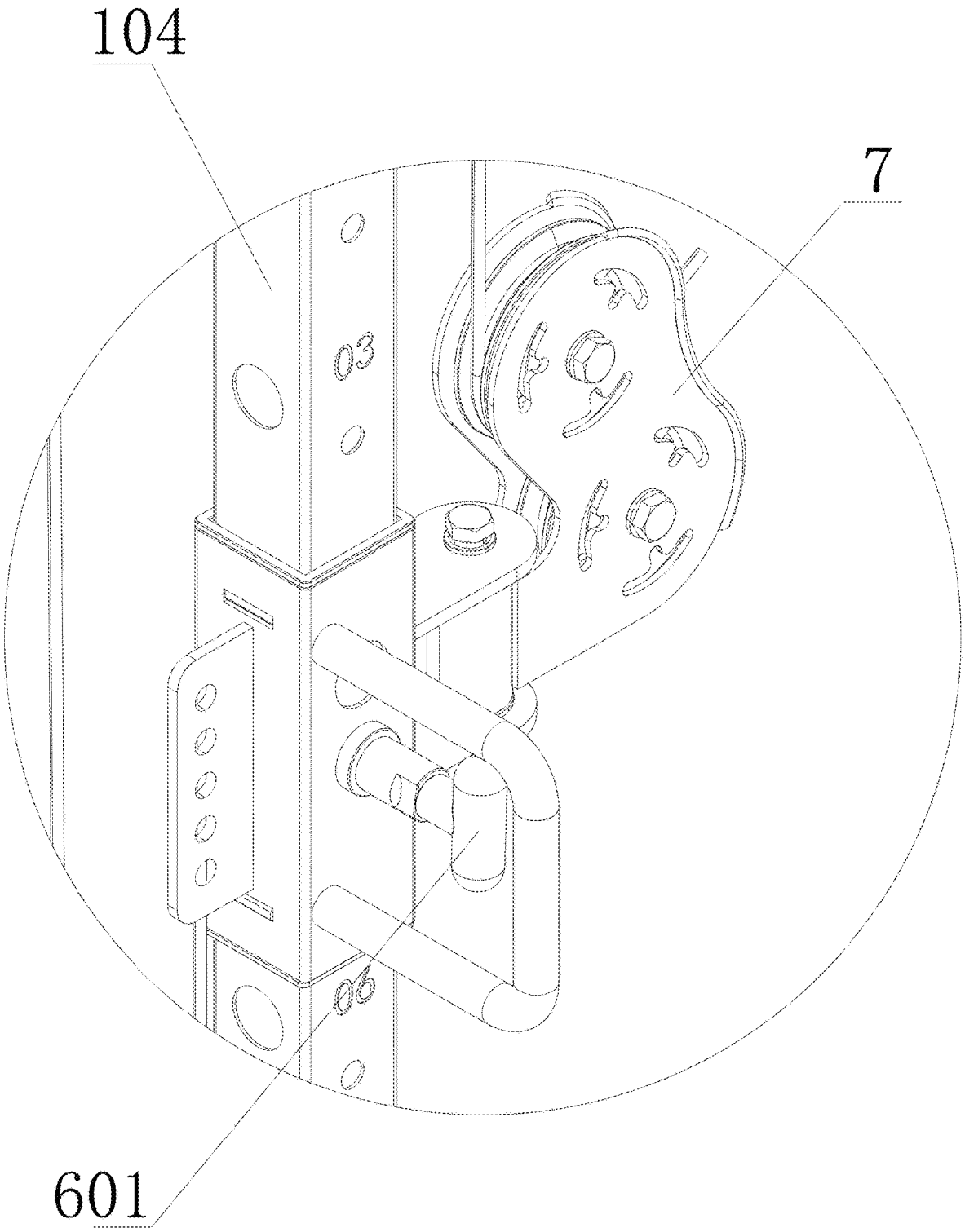
FIG. 4 is an enlarged view of a part E shown in FIG. 1.
Figure 5:
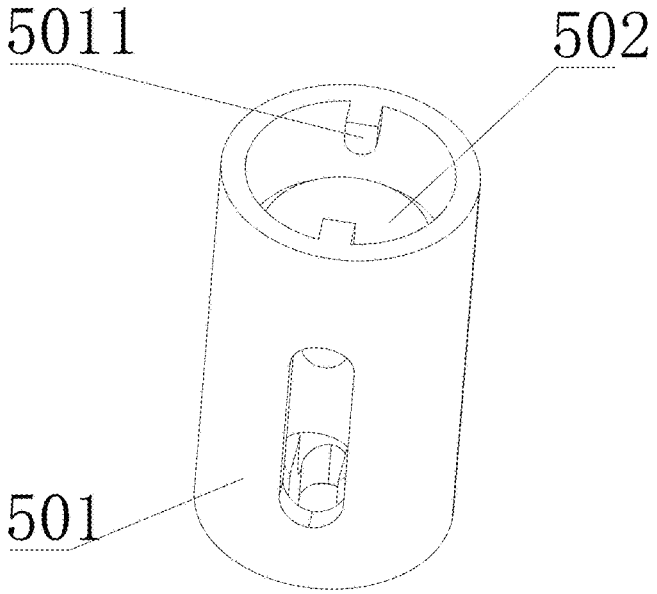
FIG. 5 is a structural diagram of a connector A.
Figure 6:
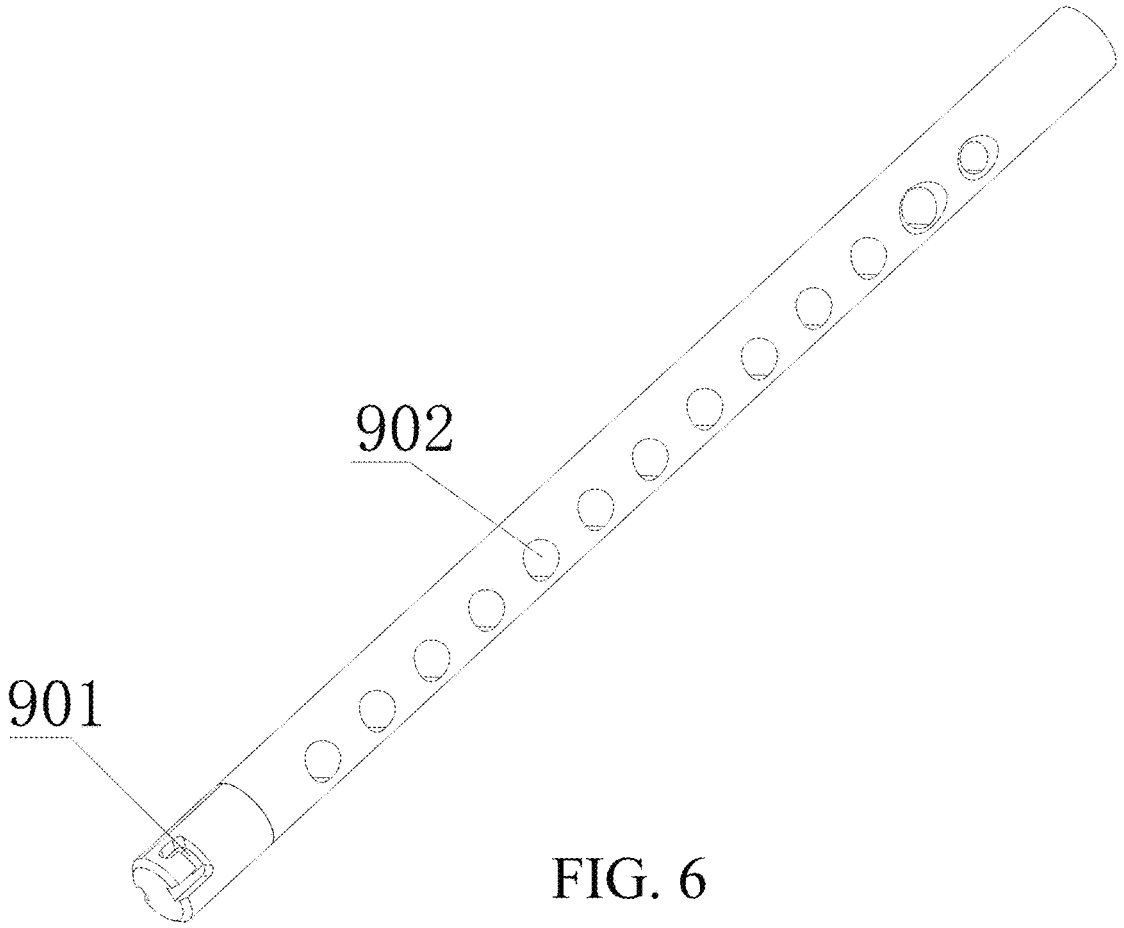
FIG. 6 is a stereoscopic view of a pull rod A.

Reference Numerals: 1. frame; 101. guide shaft; 102. support sleeve; 103. support member; 104. longitudinal adjustment beam; 1041. adjustment hole; 105. shock-absorbing pad; 2. movable pulley; 3. weight stack; 4. lower fixed pulley; 5. connector A; 501. outer cylinder; 5011. protrusion; 502. inner core; 6. sliding sleeve connector; 601. spring pin; 7. fly sliding sleeve; 8. upper fixed pulley; 9. pull rod A; 901. groove; 902. weight stack connection hole; 10. connector B; 1001. hook; 11. pull rod B; 1101. suspension ring; 12. connector C; 1201. internal thread; 13 pull rod C; 1301. external thread; 14. connector D; 1401. ball head; 15. pull rod D; and 1501. open groove.

DETAILED DESCRIPTION OF THE EMBODIMENTS

Embodiment 1

As shown in FIGS. 1 to 6, this embodiment provides a pulling force switching method, which includes the following steps.

S1. Weight stack 3 is lifted to a position below movable pulley 2, and a rope at one side of the movable pulley 2 is connected to a handle as a force application end.

S2. The rope at the other side of the movable pulley 2 is wound upwards around a fixed pulley located higher than the movable pulley 2, wound downwards around a fixed pulley located lower than the movable pulley 2, and finally fixed to connector A 5. The connector A 5 is detachably connected to the movable pulley 2. Support member 103 is located below the connector A 5. The support member 103 is configured to restrict a lower limit position of the connector A 5.

S3. The connector A 5 is separated from the movable pulley 2, and the handle is pulled. The connector A 5 is supported by the support member 103, and a pulling force at the force application end is half of a gravity of the weight stack 3. The connector A 5 is connected to the movable pulley 2, and the handle is pulled. The connector A 5 is driven by the movable pulley 2, and a pulling force at the force application end is equal to the gravity of the weight stack 3.

This embodiment further provides a pulling force switching device based on the pulling force switching method, which is implemented through the following technical solution. The pulling force switching device includes frame 1. The weight stack 3 is movably provided on the frame 1. The weight stack 3 is detachably connected to the movable pulley 2. Upper fixed pulley 8 and lower fixed pulley 4 are fixedly provided on the frame 1. A position of the upper fixed pulley 8 is higher than a position of the movable pulley 2, and a position of the lower fixed pulley 4 is lower than the position of the movable pulley 2.

The rope is wound around the movable pulley 2. The rope at one side of the movable pulley 2 is connected to the handle, and the rope at the other side of the movable pulley 2 is wound around the upper fixed pulley 8 and the lower fixed pulley 4 sequentially and fixed to the connector A 5. The connector A 5 is movable. The support member 103 is located below the connector A 5. The support member 103 is fixed to a lower part of the frame 1. The support member 103 is configured to restrict the lower limit position of the connector A 5. The connector A 5 is detachably connected to the movable pulley 2.

In this embodiment, guide shafts 101 are fixedly provided on the frame 1. There are two guide shafts 101. The two guide shafts are arranged in parallel. The weight stack 3 is slidably connected to the guide shafts 101. Pull rod A 9 is suspended below the movable pulley 2. The weight stack 3 is detachably connected to the movable pulley 2 through the pull rod A 9. The connector A 5 is detachably connected to the movable pulley 2 through the pull rod A 9.

The connector A 5 includes inner core 502 and outer cylinder 501. The outer cylinder 501 is sleeved outside the inner core 502 and fixedly connected to the inner core 502. The inner core 502 is fixedly connected to an end of the rope.

An inner wall of the outer cylinder 501 is provided with protrusion 5011. A bottom of the pull rod A 9 is provided with groove 901 that matches the protrusion 5011. The groove 901 is in an inverted L-shape. A long side of the groove 901 is communicated with an end position of the pull rod A 9. The protrusion 5011 of the outer cylinder 501 is aligned with and insert into the groove 901 of the pull rod A 9. Then the outer cylinder 501 is rotated to connect the pull rod A 9 to the connector A 5. The pull rod A 9 is provided with multiple weight stack connection holes 902. A side of the weight stack 3 is provided with through-holes. Positions of the weight stack connection holes 902 correspond to positions of the through-holes of the weight stack 3. The pull rod A 9 is connected to the weight stack 3 through the weight stack connection hole 902. A pin is inserted through the through-hole of the weight stack 3 and passes through the weight stack connection hole 902 of the pull rod A 9 to connect the pull rod A 9 to the weight stack 3.

The rope on the movable pulley 2 close to a force application side extends upwards, is wound around multiple fixed pulleys, and is finally connected to the handle. The handle is restricted by fly sliding sleeve 7. The fly sliding sleeve 7 is rotatably connected to sliding sleeve connector 6 to adapt to a change in a direction of force application. The sliding sleeve connector 6 is slidably provided on longitudinal adjustment beam 104 of the frame 1. The longitudinal adjustment beam 104 is a square tube profile. The longitudinal adjustment beam 104 is provided with multiple adjustment holes 1041. The sliding sleeve connector 6 is provided with spring pin 601 and connected to the longitudinal adjustment beam 104 through the spring pin 601. When it is necessary to adjust a height of the fly sliding sleeve 7, the spring pin 601 is pulled outward to separate it from the longitudinal adjustment beam 104. After the fly sliding sleeve is adjusted to an appropriate height, the spring pin 601 is released. The spring pin 601 is reset by an internal spring, allowing the spring pin 601 to be locked and connected again to the longitudinal adjustment beam 104. A bottom of the guide shaft 101 is provided with support sleeve 102. The support sleeve 102 is configured to support the weight stack 3. Shock-absorbing pad 105 is located above the support sleeve 102 for shock absorption.

The working principle of the present disclosure is as follows.

Figure 13:
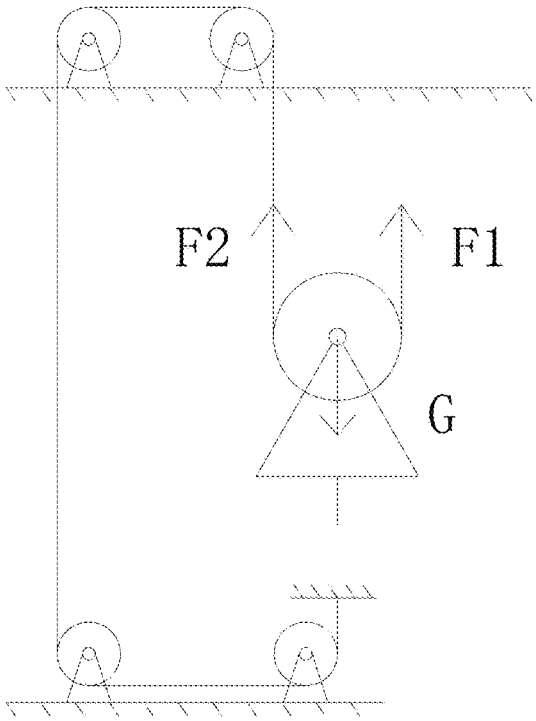
FIG. 13 is a force analysis diagram showing that a pulling force output by a weight stack is equal to half of a gravity of the weight stack.

When the user needs the pulling force output by the weight stack 3 to be equal to half of the gravity of the weight stack, the pull rod A 9 needs to be separated from the connector A 5. As shown in FIG. 13, at this point, the pulling force that the user needs to apply is F1, and the gravity acting on the weight stack 3 is G=F1+F2, which is a total pulling force of the rope at the two sides of the movable pulley 2, F1=F2. Therefore, the pulling force at the handle end is half of the gravity of the weight stack 3.

Figure 14:
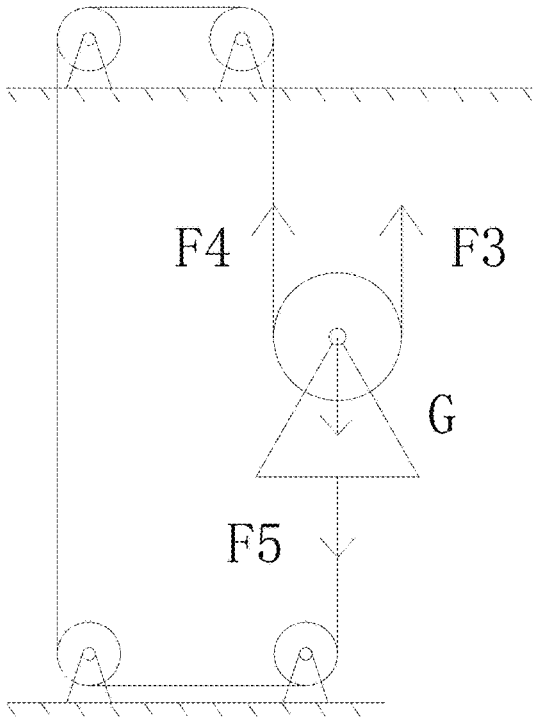
FIG. 14 is a force analysis diagram showing that the pulling force output by the weight stack is equal to half of the gravity of the weight stack.

When the user needs the pulling force output by the weight stack 3 to be equal to the gravity of the weight stack, the pull rod A 9 needs to be connected to the connector A 5. As shown in FIG. 14, at this point, the user needs to apply a pulling force of F3, F3+F4=G+F5. F4 and F5 are pulling forces on the same rope, equal in magnitude and opposite in direction. Therefore, G=F3. At this point, a pulling force at the handle end is equal to the gravity of the weight stack 3.

Embodiment 2

Figure 7:
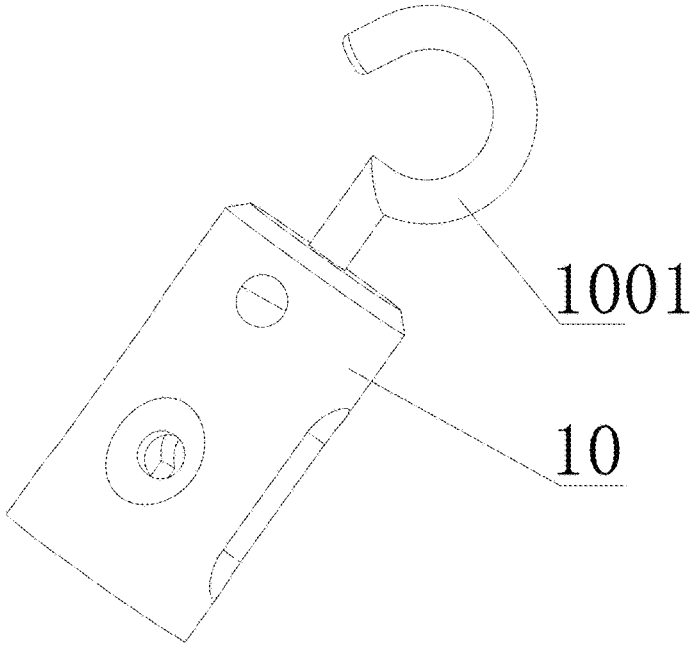
FIG. 7 is a structural diagram of a connector B.
Figure 8:
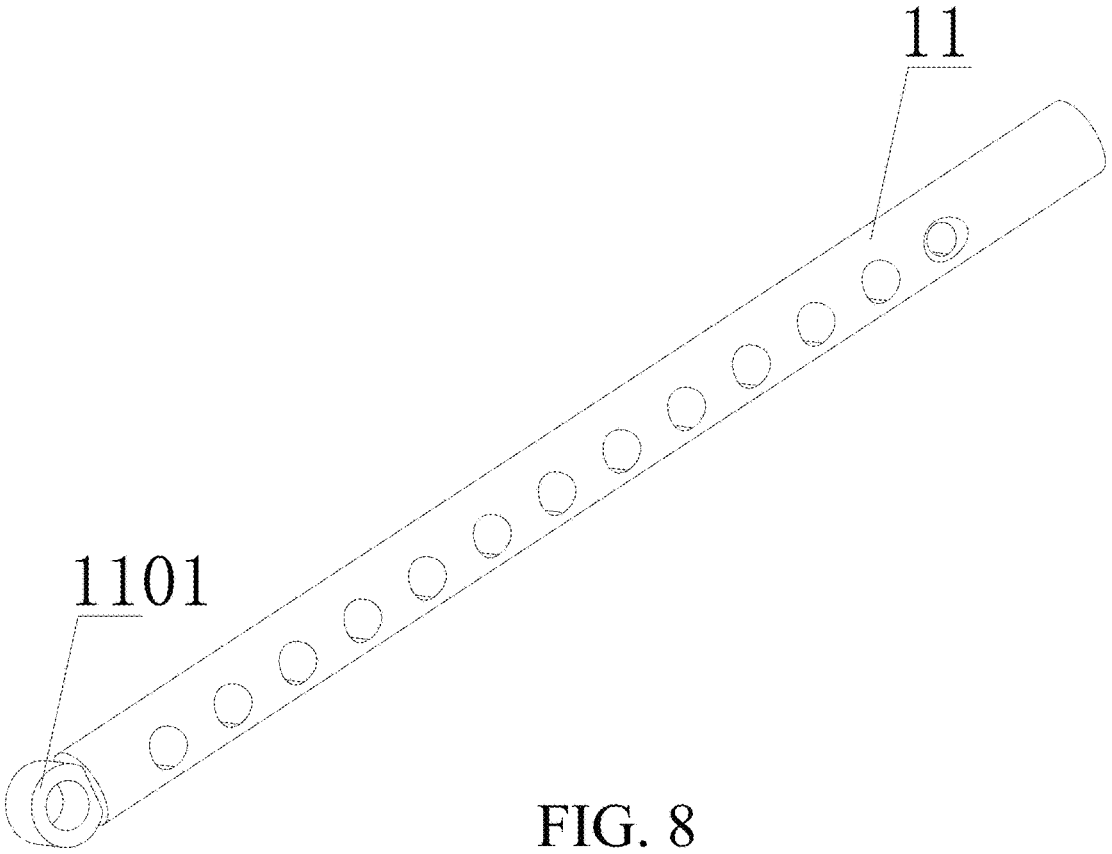
FIG. 8 is a stereoscopic view of a pull rod B.

As shown in FIGS. 7 and 8, the connector is connector B 10, and the pull rod is pull rod B 11. The connector B 10 is provided with hook 1001. The bottom of the pull rod B 11 is provided with suspension ring 1101 that matches the hook 1001.

Embodiment 3

Figure 9:
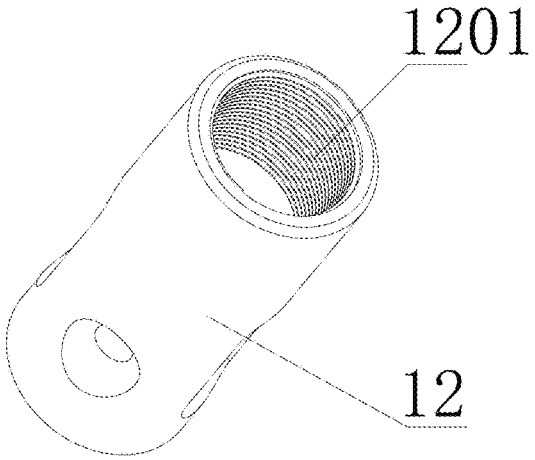
FIG. 9 is a structural diagram of a connector C.
Figure 10:
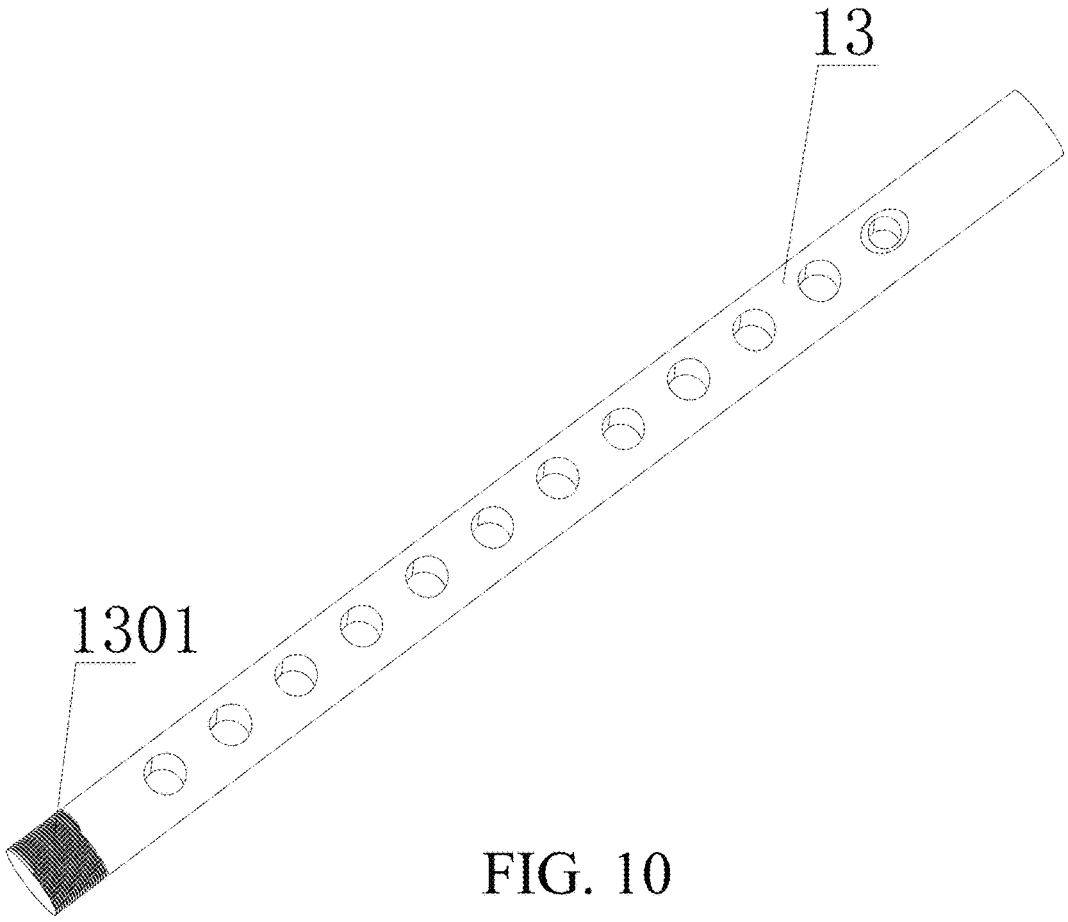
FIG. 10 is a stereoscopic view of a pull rod C.

As shown in FIGS. 9 and 10, the connector is connector C 12, and the pull rod is pull rod C 13. The connector C 12 is provided with internal thread 1201. The bottom of the pull rod C 13 is provided with external thread 1301 that matches the internal thread 1201.

Embodiment 4

Figure 11:
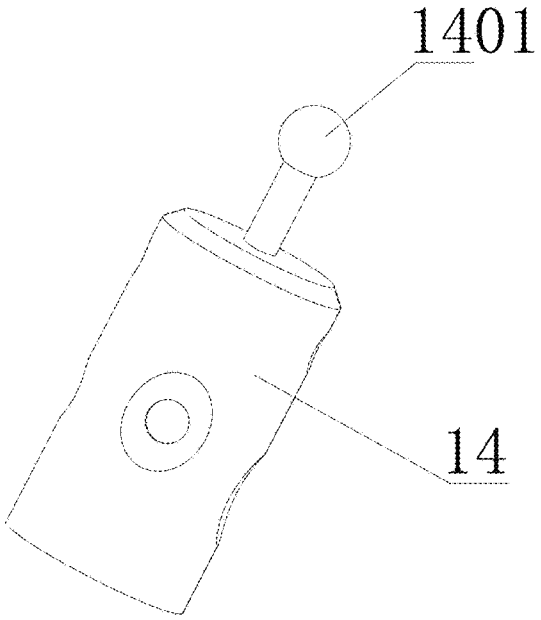
FIG. 11 is a structural diagram of a connector D.
Figure 12:
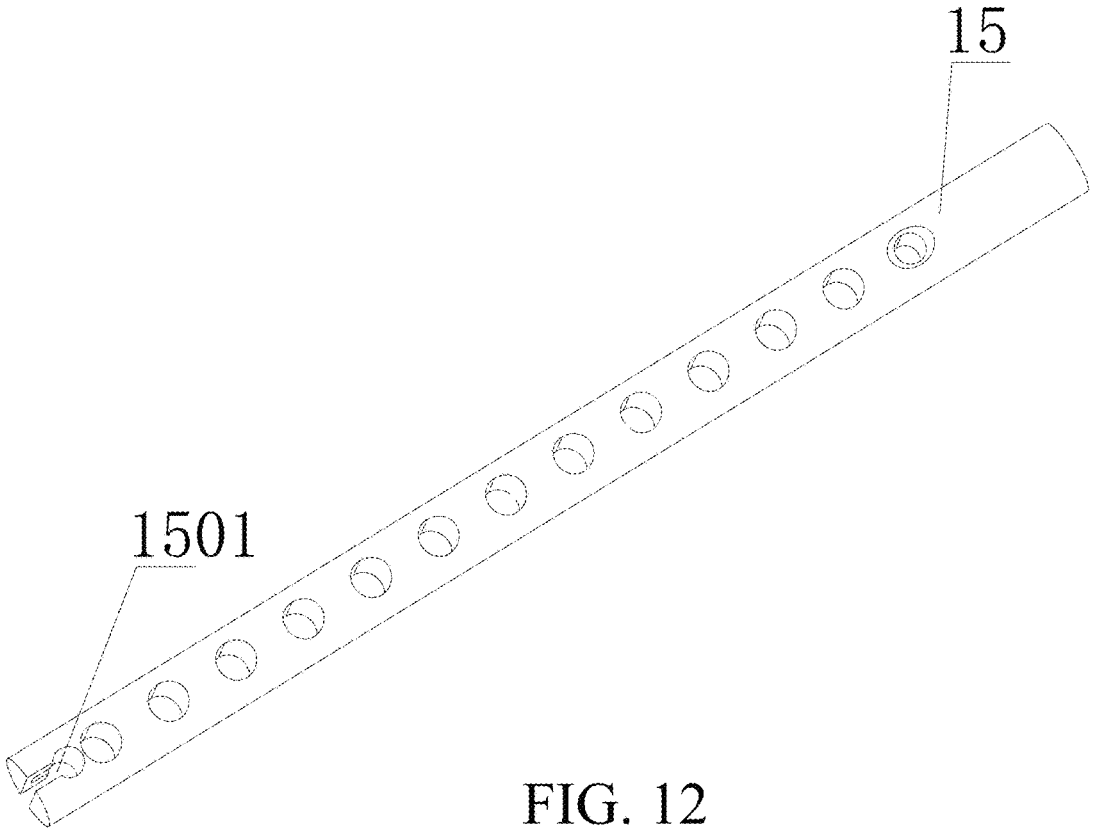
FIG. 12 is a stereoscopic view of the pull rod D.

As shown in FIGS. 11 and 12, the connector is connector D 14, and the pull rod is pull rod D 15. The connector D 14 is provided with ball head 1401. The bottom of the pull rod D 15 is provided with open groove 1501 that matches the ball head 1401.

What is claimed is:

1. A pulling force switching device, comprising a frame, wherein a weight stack is movably provided on the frame; the weight stack is detachably connected to a movable pulley; an upper fixed pulley and a lower fixed pulley are fixedly provided on the frame; a position of the upper fixed pulley is higher than a position of the movable pulley; and a position of the lower fixed pulley is lower than the position of the movable pulley; and a rope is wound around the movable pulley; the rope at a first side of the movable pulley is connected to a handle, and the rope at a second side of the movable pulley is wound around the upper fixed pulley and the lower fixed pulley sequentially and fixed to a connector; the connector is movable; a support member is located below the connector to restrict a lower limit position of the connector; and the connector is detachably connected to the movable pulley;

wherein a guide shaft is fixedly provided on the frame; the weight stack is slidably connected to the guide shaft; a pull rod is suspended below the movable pulley; the weight stack is detachably connected to the movable pulley through the pull rod; and the connector is detachably connected to the movable pulley through the pull rod; and wherein the connector is defined as a first connector, and the pull rod is defined as a first pull rod; the first connector comprises an inner core and an outer cylinder; the outer cylinder is sleeved outside the inner core and fixedly connected to the inner core; the inner core is fixedly connected to an end of the rope; an inner wall of the outer cylinder is provided with a protrusion; a bottom of the first pull rod is provided with a groove, the groove is matched with the protrusion; the groove is in an inverted L-shape; and a long side of the groove is communicated with an end position of the first pull rod.

2. The pulling force switching device according to claim 1, wherein after extending upwards, the rope on the movable pulley close to a force application end is wound around a plurality of fixed pulleys and connected to the handle; the handle is restricted by a fly sliding sleeve; and the fly sliding sleeve is rotatably connected to a sliding sleeve connector.

3. The pulling force switching device according to claim 2, wherein the sliding sleeve connector is slidably provided on a longitudinal adjustment beam of the frame; the longitudinal adjustment beam is made of a square tube profile and provided with a plurality of adjustment holes; and the sliding sleeve connector is provided with a spring pin and connected to the longitudinal adjustment beam through the spring pin.

4. The pulling force switching device according to claim 1, wherein the pull rod is provided with a plurality of weight stack connection holes; a side of the weight stack is provided with through-holes; positions of the plurality of weight stack connection holes correspond to positions of the through-holes of the weight stack; and the pull rod is connected to the weight stack through the plurality of weight stack connection holes.

5. A pulling force switching method based on the pulling force switching device according to claim 1, comprising the following steps:

S1: lifting the weight stack to a position below the movable pulley, and connecting the rope at the first side of the movable pulley to the handle as a force application end;

S2: winding the rope at the second side of the movable pulley upwards around the upper fixed pulley located higher than the movable pulley, winding the rope downwards around the lower fixed pulley located lower than the movable pulley, and finally fixing the rope to the connector, wherein the connector is detachably connected to the movable pulley; the support member is located below the connector; and the support member is configured to restrict the lower limit position of the connector; and S3: separating the connector from the movable pulley, and pulling the handle, such that the connector is supported by the support member, and a pulling force at the force application end is half of a gravity of the weight stack; and connecting the connector to the movable pulley, and pulling the handle, such that the connector is driven by the movable pulley, and the pulling force at the force application end is equal to the gravity of the weight stack.

6. A pulling force switching device, comprising a frame, wherein a weight stack is movably provided on the frame; the weight stack is detachably connected to a movable pulley; an upper fixed pulley and a lower fixed pulley are fixedly provided on the frame; a position of the upper fixed pulley is higher than a position of the movable pulley; and a position of the lower fixed pulley is lower than the position of the movable pulley; and a rope is wound around the movable pulley; the rope at a first side of the movable pulley is connected to a handle, and the rope at a second side of the movable pulley is wound around the upper fixed pulley and the lower fixed pulley sequentially and fixed to a connector; the connector is movable; a support member is located below the connector to restrict a lower limit position of the connector; and the connector is detachably connected to the movable pulley;

wherein a guide shaft is fixedly provided on the frame; the weight stack is slidably connected to the guide shaft; a pull rod is suspended below the movable pulley; the weight stack is detachably connected to the movable pulley through the pull rod; and the connector is detachably connected to the movable pulley through the pull rod; and wherein the connector is defined as a first connector, and the pull rod is defined as a first pull rod; the first connector is provided with an internal thread; a bottom of the first pull rod is provided with an external thread, and the external thread is matched with the internal thread.

7. A pulling force switching device, comprising a frame, wherein a weight stack is movably provided on the frame; the weight stack is detachably connected to a movable pulley; an upper fixed pulley and a lower fixed pulley are fixedly provided on the frame; a position of the upper fixed pulley is higher than a position of the movable pulley; and a position of the lower fixed pulley is lower than the position of the movable pulley; and a rope is wound around the movable pulley; the rope at a first side of the movable pulley is connected to a handle, and the rope at a second side of the movable pulley is wound around the upper fixed pulley and the lower fixed pulley sequentially and fixed to a connector; the connector is movable; a support member is located below the connector to restrict a lower limit position of the connector; and the connector is detachably connected to the movable pulley;

wherein a guide shaft is fixedly provided on the frame; the weight stack is slidably connected to the guide shaft; a pull rod is suspended below the movable pulley; the weight stack is detachably connected to the movable pulley through the pull rod; and the connector is detachably connected to the movable pulley through the pull rod; and wherein the connector is defined as a first connector, and the pull rod is defined as a first pull rod; the first connector is provided with a ball head; a bottom of the first pull rod is provided with an open groove, and the open groove is matched with the ball head.

* * * * *